United States Patent [19]

Pearson

[11] 4,313,324

[45] Feb. 2, 1982

[54] REVERSIBLE BENDING MACHINE

[75] Inventor: John Pearson, Vista, Calif.

[73] Assignee: Eaton-Leonard Corporation, Carlsbad, Calif.

[21] Appl. No.: 33,158

[22] Filed: Apr. 25, 1979

[51] Int. Cl.[3] ..... B21D 7/04

[52] U.S. Cl. ..... 72/149; 72/305; 72/307; 72/310

[58] Field of Search ..... 72/149–159, 72/216, 217, 218, 306, 307, 310, 318, DIG. 16, 384, 442, 477, 305; 29/33 C, 33 J, 33 T

[56] References Cited

U.S. PATENT DOCUMENTS

| | | | |
|---|---|---|---|
| 3,017,917 | 1/1962 | Streit | 72/310 |
| 3,373,587 | 3/1968 | Shubin et al. | 72/158 |
| 3,544,284 | 12/1970 | Iannucci | 29/33 C |
| 3,974,676 | 8/1976 | Eaton | 72/307 |
| 4,022,045 | 5/1977 | Riha | 72/307 X |
| 4,063,441 | 12/1977 | Eaton | 72/151 |
| 4,112,728 | 9/1978 | Noack et al. | 72/154 |
| 4,201,073 | 5/1980 | Eaton | 72/155 |

FOREIGN PATENT DOCUMENTS

| | | | |
|---|---|---|---|
| 537904 | 11/1931 | Fed. Rep. of Germany | 72/384 |
| 1274621 | 9/1961 | France . | |
| 21217568 | 8/1972 | France | 72/384 |

*Primary Examiner*—Ervin M. Combs

*Attorney, Agent, or Firm*—Gausewitz, Carr, Rothenberg & Edwards

[57] ABSTRACT

A rotary pipe bending machine employs two sets of bending dies for making either right-hand or left-hand bends about a horizontal axis. A pipe handling carriage having a laterally offset chuck is slidably mounted along a track to longitudinally and rotationally position pipe with respect to the machine bending head. The track is pivotally mounted for 180° of rotation about an axis extending longitudinally through the track so that the chuck can be positioned on one side or the other of the longitudinal machine center line. This enables the chuck to position a pipe to be bent by the die set on either side of the machine.

11 Claims, 8 Drawing Figures

REVERSIBLE BENDING MACHINE

This invention is an improvement on the apparatus disclosed in the co-pending application of Homer L. Eaton, Ser. No. 887,725, filed Mar. 17, 1978, now U.S. Pat. No. 4,201,073 the disclosure of which is incorporated by this reference as though fully set forth herein.

BACKGROUND OF THE INVENTION

The present invention relates to pipe bending machines and more particularly concerns such machines that are able to make either right-hand or left-hand bends.

In the use of rotary bending machines to make a series of bends in a pipe, the direction of the several bends must be so chosen that when making the second or subsequent bend in a given length of pipe, the previously bent pipe portion, which extends forwardly and at an angle because of the prior bend, does not interfere with the bending head itself. Thus, the direction of each bend is often selected so that the previously bent pipe portion will move away from rather than toward the bend head during the bending operation. In any event, it must not move so as to interfere with or engage the bend head or other parts of the machine. Different required configurations of pipe may require different directions of bend, and thus it has been the practice to change dies or select other bend dies when changing from a right-hand bend to a left-hand bend.

U.S. Pat. No. 3,017,917 to Streit shows a machine adapted for right-hand and left-hand bending without tooling changeover. According to this patent, the entire bend head, including its support and driving mechanism, must be rotated through a full 180°, but no carriage or automatic pipe handling apparatus is employed.

In a co-pending application of Homer L. Eaton, Ser. No. 887,725 filed Mar. 17, 1978, now U.S. Pat. No. 4,201,073 and assigned to the assignee of the present application, there is described an automatic rotary bending machine capable of making right-hand and left-hand bends in which first and second sets of rotary bend dies are mounted on a common horizontal bend axis and a pipe handling carriage is mounted for motion along a horizontal track to advance a pipe toward the bend head and to position the pipe rotationally about the pipe axis. This machine is arranged to provide right-hand or left-hand bending by supporting the track at its rear for pivotal motion about a vertical axis and detachably connecting the track at its forward end to the bend head support so that it may be connected in alignment with either one of the two sets of bend dies. To change the set up of this machine of the co-pending application of Homer Eaton from right-hand to left-hand bending requires disconnecting the track from the bend head support, pivoting the track at its rear support, also pivotally shiffting the bend head support, and then reconnecting the forward end of the track to the bend head support. This operation requires several steps and is time consuming.

Accordingly, it is an object of the present invention to provide a bending machine for making either right-hand or left-hand bends which avoids or eliminates above-mentioned problems.

SUMMARY OF THE INVENTION

In carrying out principles of the present invention, according to a preferred embodiment thereof, a reversible bending machine has a bending head that includes first and second sets of bending dies and a carriage is mounted to move an elongated work piece in a direction toward the bending head. The carriage is supported for pivotal motion relative to the bending head about a carriage axis that extends in the direction of carriage motion so as to selectively position a work piece at one or the other of the bending die sets. More specifically, the carriage is slidably mounted on an elongated track which itself is pivotally mounted at its ends for motion about an axis extending longitudinally of the track. The carriage mounts a pipe handling chuck which is offset from the track rotation axis in a direction parallel to the bend axis and, therefore, rotation of the track carriage and chuck enable the chuck to travel along either a first path toward one set of bend dies or along a second path toward the other set of bend dies.

DETAILED DESCRIPTION

Figure 1:
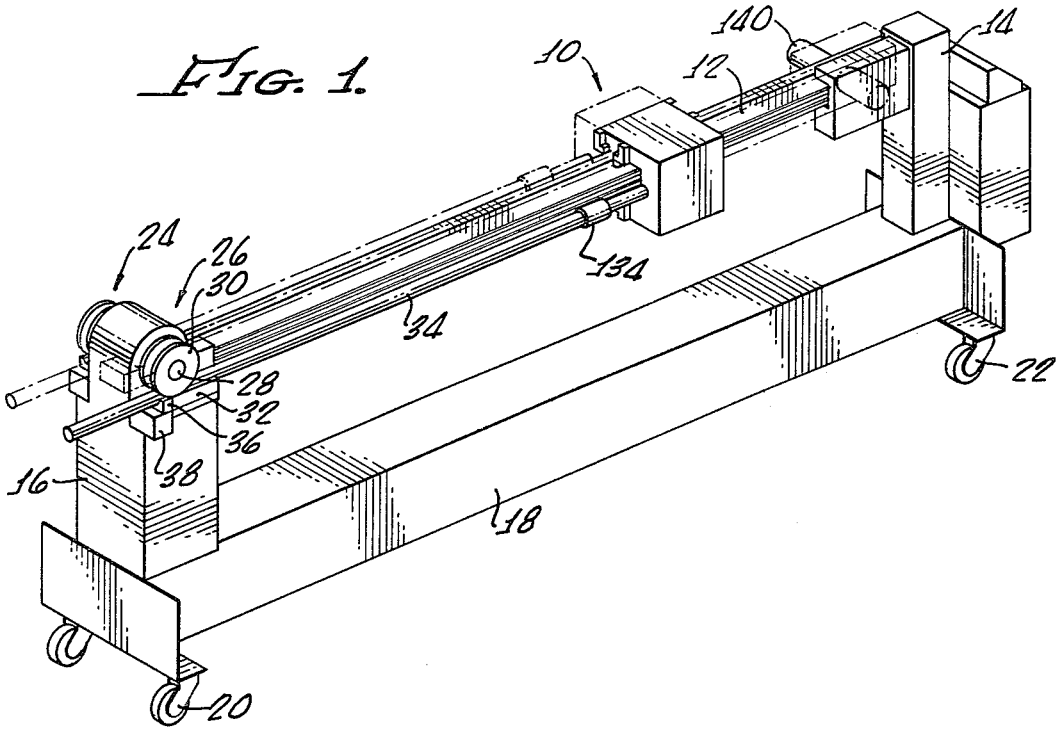
FIG. 1 is a simplified perspective view of a bending machine embodying principles of the present invention.

Illustrated in FIG. 1 is a pipe bending machine basically identical to the machine described in the above-identified pending patent application of Homer L. Eaton, differing in certain aspects to be described below. Differences of the present apparatus reside in the method of mounting the track and the position of the chuck relative to the track.

The machine includes a pipe feeding carriage 10 slidably mounted on a carriage track 12 that is supported at one end upon a rear support 14 and at the other end upon a bending head support 16. For improved portability of the described apparatus, supports 14 and 16 are fixedly mounted upon a horizontal machine frame 18 which in turn is supported at the front and back of the apparatus by wheels 20 and 22.

A bend head mounted upon the bend head support 16 includes first and second bend die assemblies 24, 26 that are positioned on opposite ends of a common bend die shaft 28 having a horizontal axis about which bending takes place. The two sets of bend dies thus provide for alternative right-hand or left-hand bending on this single machine. The two sets of bend dies may include dies of different sizes or may be identical to each other except for the right-hand and left-hand orientation of the dies on opposite ends of the common shaft 28. Each bend die set includes a rotary bend die 30, a pressure die 32 that is movable vertically to press a pipe 34 against the bend die, and a clamp die 36 also movable vertically to clamp a pipe against the die. The clamp die is mounted upon a clamp die carrier 38 for rotation together with the rotating bend die. Further details of the bending heads and their operation are described in the above-identified co-pending application of Homer Eaton.

Figure 6:
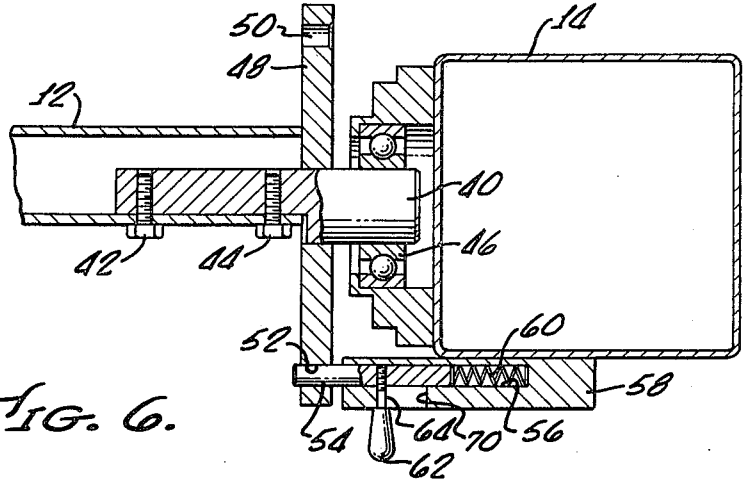
FIG. 6 is a fragmentary sectional view of showing details of the rear mounting of the track.
Figure 5:
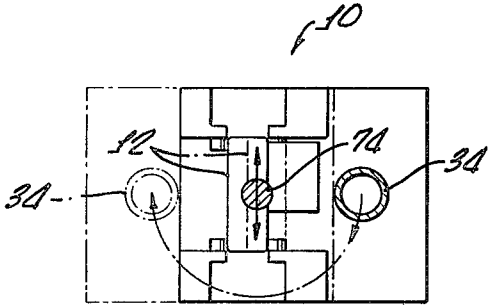
FIG. 5 is a section taken on lines 5—5 of FIG. 3.

Carriage track 12 is formed as a hollow rectangular rail or beam having a rear support shaft 40 (FIG. 6) fixed to the beam as by bolts 42, 44 and extending rearwardly of the beam. The end of the rearwardly projecting shaft 40 is journalled in a self-aligning bearing 46 having an inner race fixed to the shaft and an outer race fixed to rear support 14.

A circular latch plate 48 is fixedly connected to the shaft 40 and beam 12 and is formed with a pair of diametrically opposite latching apertures 50, 52 which are adapted to selectively receive a latch pin 54. Pin 54 is slidably mounted in a longitudinally extending bore 56 formed in a latch pin support bar 58 that is fixed to rear support 14. Pin 54 is urged outwardly of bar 58 (forwardly of the apparatus) by a compression spring 60 interposed between an end of the pin and the bottom of bore 56. An operating handle 62 is fixed to a shaft 64 that is threaded into latch pin 54 and extends through an elongated slot 70 formed in the latch pin support bar 58. The pin 54, which is urged forwardly into one or the other of the latch pin apertures 50, 52 may be readily withdrawn for insertion into the other of the apertures.

Figure 3:
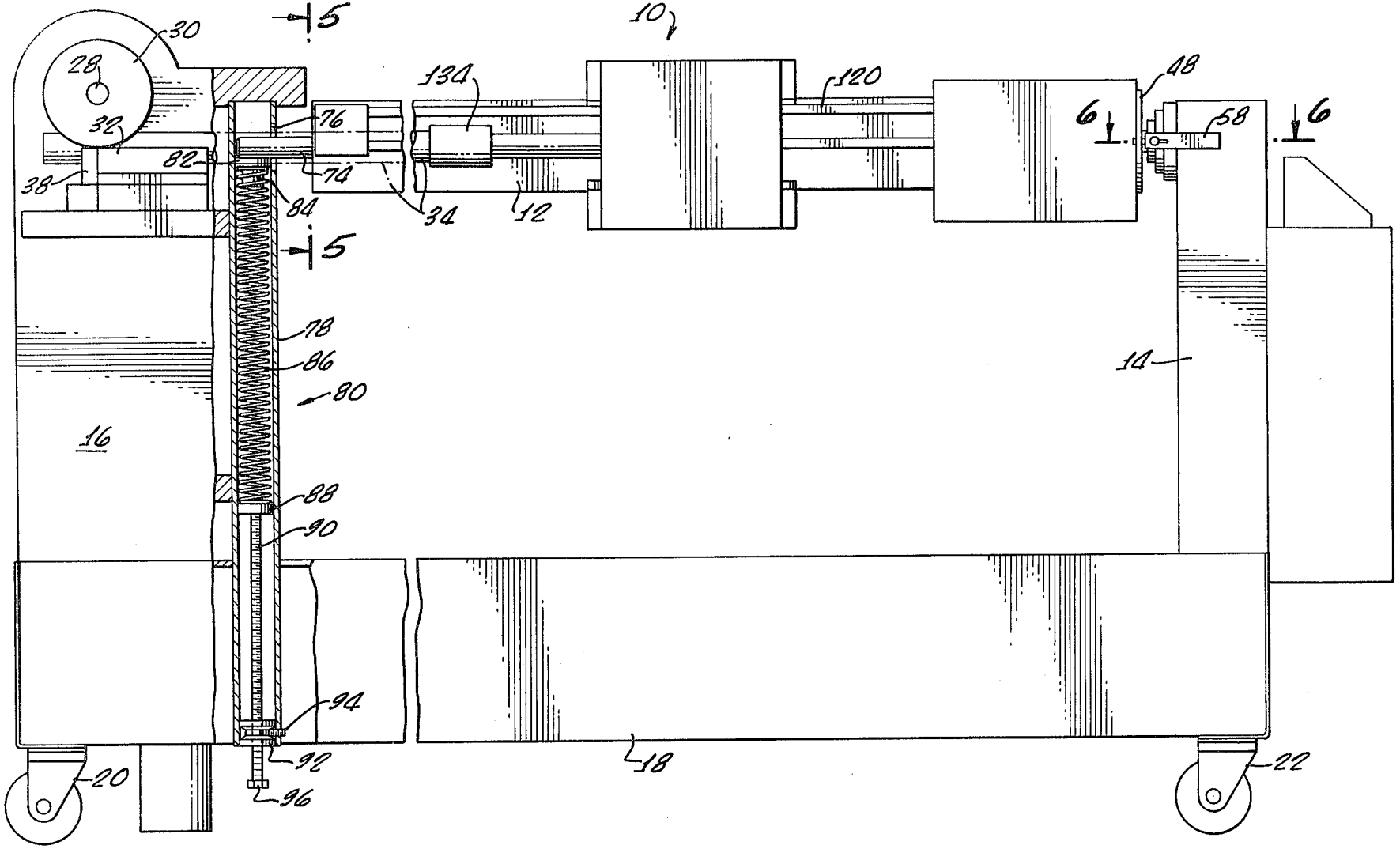
FIG. 3 is a side elevation view, partly in section, showing the mounting of the rotatable track.

The forward end of the track 12 fixedly carries a forward support shaft 74 (FIG. 3) that extends through a vertically elongated slot 76 formed in a rearward wall 78 of a vertically extending track support housing 80 fixed to the rearward side of the bend head support 16.

Shafts 74 and 40 are mutually coaxial and their common axis defines the axis of rotation of the track 12 and the axis of rotation of the carriage 10.

Shaft 74 rests upon a horizontal floating support plate 82 having a fixed depending stub shaft 84 extending into a long compression spring 86. The spring extends downwardly from the floating support plate 82, near the upper end of housing 80, to a point near the bottom of the housing where the spring bottom rests upon a disc 88 that is fixedly carried upon a vertically adjustable rod 90. The lower end of rod 90 is threaded in a nut 92 fixed to the lower end of housing 80 by means of a number of set screws 94 that are threaded in the housing wall and bear against the nut. Rod 90 carries a tool receiving head 96 at its lower end to facilitate rotation of the rod. This provides vertical adjustment of the lower end of the spring 86 to adjust the spring compression for the weight and normal vertical position of the forward end of the track.

Figure 2:
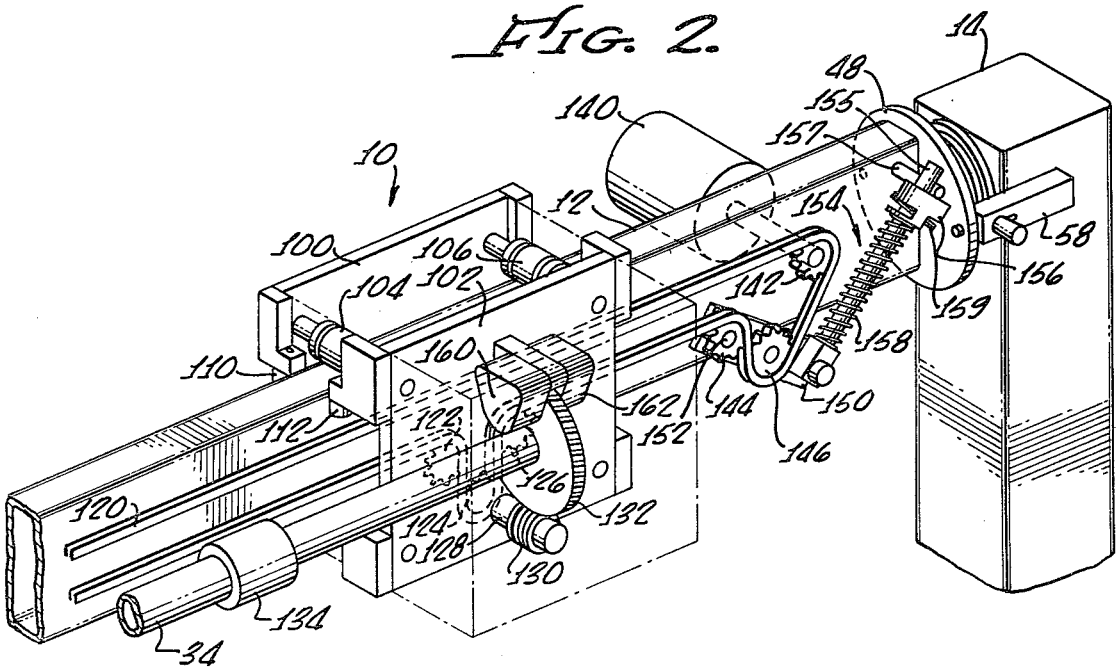
FIG. 2 is a perspective illustration of portions of the track, carriage and drive mechanism of the apparatus of FIG. 1.
Figure 4:
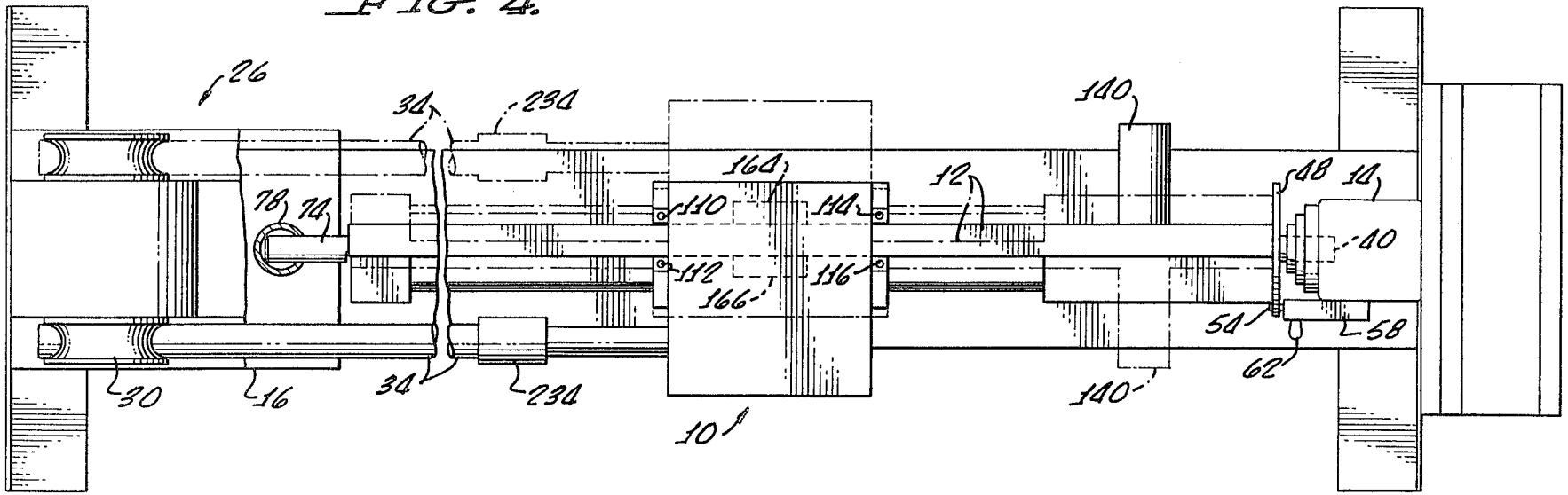
FIG. 4 is a plan view of the apparatus.

Carriage 10 and its drive are basically the same as the carriage and drive of the above-identified co-pending application of Eaton, and also the same as that described in U.S. Pat. No. 3,,974,676. The carriage includes a pair of spaced vertically oriented walls 100, 102 (FIG. 2) fixedly connected to each other on either side of the beam 12. The carriage is slidably supported on the beam on first and second upper rollers 104, 106 and a pair of corresponding lower rollers (not shown in FIG. 2). The carriage also carries rollers bearing against opposite sides of the beam 12 at both top and bottom of the beam and at front and back of the carriage, an upper set of such rollers being indicated at 110, 112, 114, 116 in FIG. 4.

The carriage drive, which is described in greater detail in U.S. Pat. No. 3,974,676, comprises an endless chain 120 that is entrained over a set of gears 122, 124, 126 journalled on carriage wall 102. Gear 124, via shaft 128 and interengaged gears 130, 132 control rotation of a pipe holding chuck 134 that is driven by gear 132. The axis of rotation of the chuck, which coincides with the pipe axis, is parallel to but laterally offset from the axis of rotation of the track.

The chain 120 is driven by a motor 140 fixedly mounted to one side of the track 12 and carrying a chain drive gear 142 which meshes with the chain. Idler gears 144, 146 are mounted on a tension adjustment bar 150 that is pivotally mounted to the track about the axis 152 of gear 144. Pivotal position of the bar 150 and thus of the chain tension is adjusted by a mechanism generally indicated at 154 which provides a resiliently applied tension to the drive chain. A shaft 155 pivoted at its ends to bar 150 and track 12, slidably carries a lock block 156 pressed against a fixed pin 157 by a compression spring 158. Position of the shaft relative to the block 156 is controlled by a tiltable latch plate 159.

Specific details of the carriage drive may be varied as deemed necessary or desirable without departing from the principles of the present invention.

In the illustrated arrangement, a single motor-driven chain is operable to drive the carriage along the track, to effect rotation of the chuck 134 or to provide some combination of the two motions. A desired type of motion is selected by operation of a pair of rotation brakes 160, 162 mounted on the carriage wall 102 to selectively restrain rotation of chuck drive gear 132 and a pair of carriage brakes 164, 166 (FIG. 4) mounted on the carriage to selectively lock the carriage against sliding motion along the track. The brakes are remotely controlled by electrical signals as described in detail in the above-identified U.S. Pat. No. 3,974,676. To drive the carriage along the track, motor 140 is operated to drive the chain, brakes 164, 166 are released, and rotation brakes 160, 162 are actuated to restrain rotation of the chuck. Thus, the chain is in effect locked to the carriage which moves with the chain as the latter moves along the track. If chuck rotation is desired, the carriage brakes are energized and the rotation brakes released whereby the driven chain will move relative to the rotation gear 124, thus rotating this gear and the chuck.

OPERATION

To perform a bend utilizing the set of bend dies 26, the track is rotated to the position illustrated in solid lines in FIGS. 1, 2, 3, and 5 and locked in such position by insertion of the latch pin 54 into aperture 52 of the latch plate 48. The chuck 134 is now positioned to move with the carriage along a path, laterally offset from the axis of rotation of the track, that will present the pipe to the set of bend dies 26. Accordingly, the carriage is driven along the track to properly position the pipe longitudinally, the chuck is rotated to position the pipe rotationally, and bending commences. Pressure die 32 is driven upwardly to press a portion of the pipe 34 against the bend die 30. Clamp die 36 is driven toward the bend die 30 to clamp a forward portion of the pipe against the bend die, and then the bend and clamp dies are rotated together about the bend axis 28 while the longitudinally fixed pressure die 32 restrains, but does not stop, further motion of the pipe. Upon completion of a first bend, the dies are released, the carriage is advanced to longitudinally position the pipe for the next bend, the chuck is rotated to rotationally position the pipe, and the bending operation is repeated.

To enable the apparatus to employ the other set of bend dies on the other side of the machine, namely the bend die set 24, it is merely necessary to rotate the track, carriage and chuck about the track axis. This is preferably done prior to mounting a pipe in the chuck. At the very least, any pipe in the chuck must be free of the bend dies during track rotation. To effect such adjustment, handle 62 is shifted to retract the latch pin whereby the entire track and carriage, including motor and chain drive, may be readily rotated by hand through a full 180°. The assembly is arranged so that the parts are substantially statically balanced about the track axis. For example, motor 140 is oppositely disposed with respect to the direction of offset of the carriage and chuck as part of this balance of the assembly. After rotation through 180°, the second latch plate aperture 50 is aligned with the pin 154 which is retracted during the rotation of the track. Upon achieving the desired alignment, the handle 62 is released so that spring 56 will drive the latch pin into the aperture 50 and the apparatus is now in the position illustrated in dotted lines in FIGS. 1, 4 and 5. Bending in this position takes place by means of the same steps and same procedure as on the other side, except that the bend die set 24 is now employed instead of the bend die set 26. The chuck axis and also the axis of the pipe to be bent remain parallel to and laterally displaced from the axis of rotation of the track. In one position of track of rotation, the chuck and pipe axes are displaced so as to advance the pipe along a path that presents the pipe to the bend die set 26 whereas in the other position of rotation of the track, the chuck and pipe axes are offset in the opposite direction so as to move the pipe along the second path for presentation to the other set of bend dies.

Bends of different radii which are provided by employing bend dies of different radii are readily accommodated in the described apparatus by the floating support for the forward end of the track. For example, for a bend die of a larger radius, the pipe may be readily guided to and between the pressure and bend dies, automatically adjusting its height to accommodate bend die diameter. The forward end of the pipe, upon initial presentation to the bend dies, will be cammed either upwardly or downwardly by its contact with the dies, thus effecting the relatively small amount of vertical adjustment of the forward track support shaft 74 upon its spring 86 as may be required. Further, as a bend takes place and the pipe is drawn, its diameter may decrease. The floating support of the front of the track provides automatic compensation (of pipe position radially of the bend die) for such relatively small changes in pipe diameter during bending. By means of this arrangement, the forward end of the track, and thus the pipe itself, is provided with a limited freedom of motion radially of the bend axis.

Figure 7:
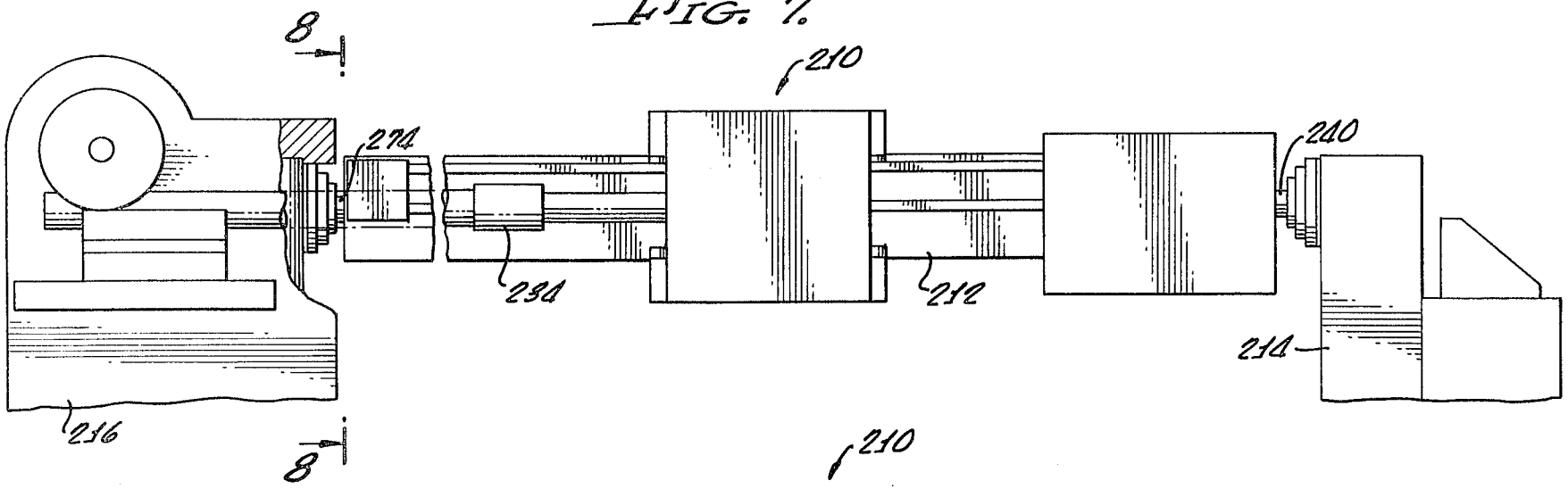
FIG. 7 is a side elevational view of a modified form of track mounting.
Figure 8:
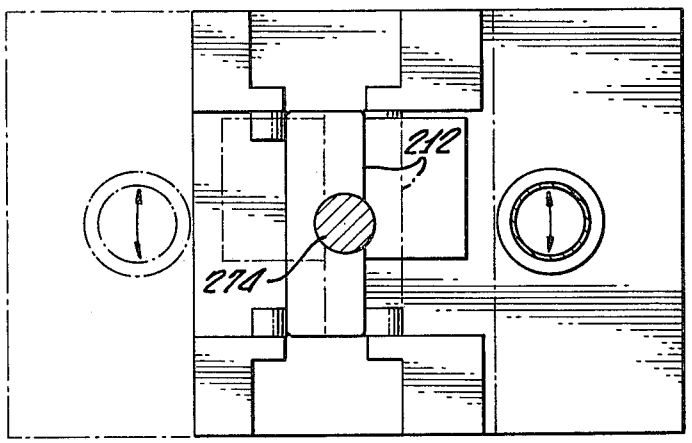
FIG. 8 is a section taken on lines 8—8 of FIG. 7.

An alternative arrangement for accommodating the desired vertical float of the front of a pipe is illustrated in FIGS. 7 and 8. The apparatus of this embodiment is identical to the apparatus previously described, except that the forward end of the track is not provided with a linear vertical float, and the rotational position of the track is not locked. The track, in this embodiment, is provided with an angular float or adjustability to accommodate small amounts of vertical adjustment. In FIGS. 7 and 8, components identical to or analogous to similar components of the first embodiment are designated by like reference numerals having the prefix "2". Thus, track 212 of FIG. 7 corresponds to track 12 of FIG. 3, carriage 210 corresponds to carriage 10, and chuck 234 corresponds to chuck 134 of the prior embodiment. In this arrangement of FIGS. 7 and 8, the track has a fixed rear support shaft 240 journalled in rear track support 214 and a forward support shaft 274 journalled about a fixed axis in the bend head support 216. The entire assembly is balanced about the axis of rotation of the track which extends centrally along the length of the track. As in the previous embodiment the chuck and carriage are offset laterally from the track axis so that as the carriage moves along the track, the chuck will advance a pipe toward one set of bend dies on one side of the apparatus. This advance is along a path parallel to the track axis and offset therefrom on one side of the apparatus.

To change the apparatus for use of the bend die set on the other side, it is merely necessary to rotate the balanced assembly about the track axis, manually adjusting the angular displacement of the track and carriage to align the chuck axis so as to present a pipe to the set of bend dies on this side. The assembly has a freedom of angular motion about the track axis, but the balance of the assembly facilitates manual restraint to the selected angular position for the initial presentation of the pipe to the bend dies. Of course once the pipe has been grasped by the bend dies, no further manual restraint is necessary or desirable.

As previously mentioned, vertical adjustment of the pipe path, that is, shifting of the pipe path radially of the bend axis, may be required for use with bend dies of different diameter, or may be necessary to accommodate the slight decrease in the diameter of the pipe as it is drawn. Such adjustment is achieved by slight angular motion of the assembly about the track axis. In either of its two diametrally opposed operating positions the chuck axis is offset from the track axis in a direction parallel to the axis of the bend die. Therefore, a rotation of the assembly about the track axis when in operating position tends to move the chuck axis through an arc that is substantially vertical. Such arc, in effect, extends radially of the bend die axis and thus provides an angular float of the forward end of the track.

The foregoing detailed description is to be clearly understood as given by way of illustration and example only, the spirit and scope of this invention being limited solely by the appended claims.

What is claimed is:

1. A reversible bending machine comprising a bending head having first and second sets of bending dies, a carriage for moving an elongated workpiece in a direction toward said bending head, and means for supporting said carriage for pivotal motion relative to said bending head about a carriage axis extending in said direction so as to selectively position a workpiece at one or the other of said sets of bending dies said carriage including a workpiece holder offset from said carriage axis, said bending dies including at least one die mounted for motion about a bend axis, and including means for mounting said workpiece holder with a limited freedom of motion radially of said bend axis.

2. The machine of claim 1 wherein said means for supporting said carriage comprises an elongated track mounted for pivotal motion about said carriage axis, said carriage being mounted for motion along said track, said track having a limited freedom of motion to provide said freedom of motion of said workpiece holder.

3. The machine of claim 1 wherein said bending dies include a rotary die having a bend axis, and wherein said carriage includes a chuck for holding a workpiece offset from said carriage axis, said means for supporting said carriage including means for providing said chuck with freedom of motion radially of said bend axis.

4. A reversible bending machine comprising a bending head having first and second sets of bending dies, a carriage for moving an elongated workpiece in a direction toward said bending head, and means for supporting said carriage for pivotal motion relative to said bending head about a carriage axis extending in said direction so as to selectively position a workpiece at one or the other of said sets of bending dies, said means for supporting said carriage comprising a rear support, a beam pivoted to and between said bending head and said rear support for motion about said axis, said carriage including anti-friction means for slidably supporting the carriage upon the beam in different pivotal positions of the beam, said carriage having a chuck support offset laterally of said beam and offset laterally of said carriage axis, whereby said chuck support will move from one side of said carriage axis to the other as said beam pivots about the carriage axis.

5. Pipe bending apparatus comprising a bending head having first and second sets of bending dies, a pipe handling assembly connected with said bending head for advancing pipe toward said dies, said assembly including, an elongated track, a carriage mounted for motion along the track, and a pipe holder on the carriage, means for mounting at least part of said assembly for motion between a first position in which the pipe holder is movable along the track toward said first set of bending dies in a first path, and a second position in which the pipe holder is movable along the track toward said second set of dies in a second path parallel to said first path said dies including at least one die mounted for rotation about a bend axis, and including means for permitting adjustment of at least one of said positions to enable said pipe holder to shift radially of said bend axis.

6. Pipe bending apparatus comprising a bending head having first and second sets of bending dies, a pipe handling assembly connected with said bending head for advancing pipe toward said dies, said assembly including, an elongated track, a carriage mounted for motion along the track, and a pipe holder on the carriage, means for mounting at least part of said assembly for motion between a first position in which the pipe holder is movable along the track toward said first set of bending dies in a first path, and a second position in which the pipe holder is movable along the track toward said second set of dies in a second path parallel to said first path, said means for mounting at least part of said assembly comprising means for mounting said track for rotation about an axis extending along the length of the track, said sets of bending dies being laterally offset on opposite sides of said axis, said pipe holder being offset from said axis and aligned with one or the other of said first and second sets of dies when said assembly is in one or the other of said first and second positions respectively.

7. The apparatus of claim 6 wherein said assembly is substantially balanced about said axis and including means for permitting adjustment of said assembly radially of said bending dies.

8. Pipe bending apparatus comprising a bend head support, a rear support, an elongated track extending between and pivoted to said supports for rotation about a track axis extending from one of said supports to the other, first and second sets of bending dies mounted on said bend head support and displaced from each other along a bend axis that is substantially perpendicular to said track axis, a carriage slidably mounted upon said track, a chuck carried on said carriage and displaced from said track axis in a direction substantially parallel to said bend axis and including means for providing freedom of motion of said chuck radially of said bend axis.

9. A machine for bending pipe on either of two sets of dies comprising, a bend head support having first and second sets of bending dies mounted thereon for bending pipe about a bend axis, said sets of dies being mutually spaced along said bend axis and being mounted to said bend head support on opposite sides thereof, a rear support, a carriage track extending between and pivoted to said supports for rotation about a track axis extending longitudinally of the track, said track axis extending substantially perpendicular to said bend axis between said sets of dies, a carriage slidably mounted on said track for motion toward and away from said bend head support, a pipe grasping chuck mounted on said carriage and including means for rotating a pipe grasped therein about the axis of the pipe, said chuck being displaced from said track axis whereby rotation of said track will rotate said carriage and chuck about said track axis so as to move said chuck and a pipe grasped thereby from a first position in alignment with said first set of bend dies on one side of said bend head support to a second position in alignment with said second set of bend dies on the other side of said bend head support.

10. The machine of claim 9 including means for enabling said chuck and a pipe grasped thereby to be adjusted radially of said bend axis.

11. The machine of claim 9 wherein said track is pivoted to said supports for limited amounts of rotational adjustability from said first and second positions.

* * * * *